United States Patent [19]

Austin

[11] 4,016,809

[45] Apr. 12, 1977

[54] CLEAN AIR WORKBENCH

[75] Inventor: Philip R. Austin, Livonia, Mich.

[73] Assignee: Contamination Control Laboratories, Inc., Livonia, Mich.

[22] Filed: July 16, 1975

[21] Appl. No.: 596,267

[52] U.S. Cl. ..... 98/115 LH; 55/DIG. 18; 55/DIG. 29; 98/41 R

[51] Int. Cl.[2] ..... F23J 11/00

[58] Field of Search ..... 98/115 LH, 115 R, 36, 98/41 R; 55/471, 472, 473, 385 A, DIG. 29, DIG. 18, 116

[56] References Cited

UNITED STATES PATENTS

| | | | |
|---|---|---|---|
| 3,229,611 | 1/1966 | Berger, Jr. | 98/115 LH |
| 3,284,148 | 11/1966 | Ramniceanu | 98/115 LH X |
| 3,318,076 | 5/1967 | Baker | 98/115 LH X |
| 3,479,947 | 11/1969 | Myers | 98/116 |
| 3,511,162 | 5/1970 | Truhan | 98/115 R X |
| 3,616,624 | 11/1971 | Marsh | 98/115 LH X |
| 3,747,505 | 7/1973 | Turko | 98/115 LH |

FOREIGN PATENTS OR APPLICATIONS

| | | | |
|---|---|---|---|
| 2,130,255 | 1/1972 | Germany | 98/36 |

*Primary Examiner*—William F. O'Dea
*Assistant Examiner*—Harold Joyce
*Attorney, Agent, or Firm*—Olsen and Stephenson

[57] ABSTRACT

Apparatus providing a work area at which one or several people can perform tasks requiring ultra-high efficient air filtration. The work area includes an air passageway throughwhich laminar flow of air occurs from a HEPA filter. The apparatus has a leading edge around the work area from which a certain of air flows in an enclosing and parallel relationship to the laminar flow air to extend the laminar air zone a distance beyond the work surface of the apparatus. The curtain air is passed through a HEPA filter prior to discharge. Dual air blowers supply air for the laminar flow air and the enclosing air curtain. The passageways for the two sources of air are in communication so that if necessary, one blower can be the source for both the laminar flow air and the air curtain. When both sources are in operation the communication means also serves to eliminate undesirable harmonics that might originate from either blower if it were to operate alone. The apparatus provides illumination of the work area, and the passageway for the air providing the air curtain serves as a heat transfer means for cooling the illuminating means.

9 Claims, 6 Drawing Figures

CLEAN AIR WORKBENCH

BACKGROUND OF THE INVENTION

The present invention relates to workbenches having clean air work areas, and more particularly to improvements in the delivery and distribution of filtered air for such benches so that a workbench is provided wherein a zone of clean air is extended beyond the normal work surface of the workbench.

It is known to provide a workbench which has an air filtration system that delivers clean air over the work surface of the workbench. A circular work center of this character is disclosed in United States Letters Patent No. 3,537,381, issued Nov. 3, 1970 to Philip R. Austin. In this work center, the work area extends around the entire circumference of the work center and air is directed radially outwardly from the center thereof. It is also known to provide a workbench wherein a rectangular work area is provided and in which the air is directed linearly outwardly from the rear of the work area. An example of a construction of this type is shown in United States Letters Patent No. 3,336,855, issued to A. J. Messina, entitled "Ultra-clean Workbench." Work centers or workbenches of the type disclosed in the prior art are limited in the degree of efficient air filtration that can be realized at the work area. In the prior art devices the movement of the filtered air beyond the work area is quickly dissipated, and in some instances eddy currents and the like may result in the return of unfiltered air and impurities into the region immediately adjacent to or even into the work area. Thus, there is need for further improvements in this field for a workbench which is characterized by its ability to provide ultra-high efficient air filtration in the work area.

SUMMARY OF THE INVENTION

The present invention has overcome the inadequacies of the prior art and has provided a workbench wherein laminar flow of air occurs through the work area and a relatively high velocity clean air curtain is discharged at the leading edge of the work area so as to extend the laminar air flow zone a substantial distance outwardly beyond the work surface. By virtue of this arrangement room air currents from any source carrying air-born contaminants are prevented from entering and violating the work area.

According to one form of the present invention, a workbench is provided comprising a work platform having a work area defined by a plurality of walls that are open at the front of the work area at a leading edge to provide access to the work area. The rear wall of the plurality of walls is a HEPA filter through which filtered air can be directed forward through the work area as laminar flow. A second source of filtered air flows through air nozzles located around said leading edge so that a curtain of clean air can be directed at relatively high velocity parallel to and surrounding the laminar flow of air from the work area. This arrangement serves to extend the laminar air flow zone many feet beyond the work area.

Thus, it is the primary object of the present invention to provide an improved workbench for performing tasks requiring ultra-high efficiency filtration.

Other objects of this invention will appear in the following description and appended claims, reference being had to the accompanying drawings forming a part of this specification wherein like reference characters designate corresponding parts in the several views.

DESCRIPTION OF THE PREFERRED EMBODIMENT

Figure 1:
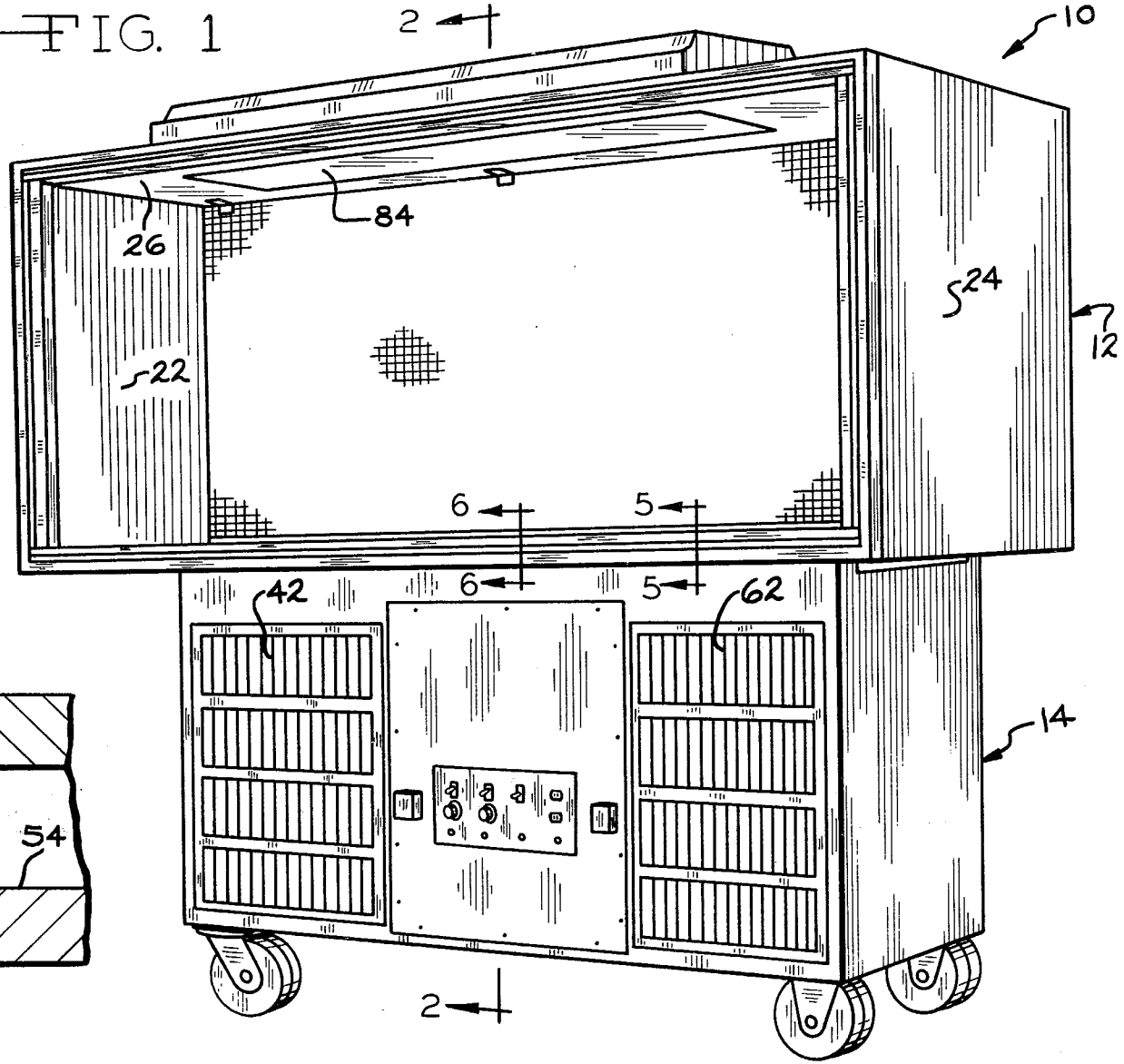
FIG. 1 is a perspective view of a clean air workbench embodying the present invention.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The clean air workbench 10 includes the work platform 12 positioned on the support stand 14. The work platform 12 has a work area 16 open at the front at a leading edge 18. The work area and the leading edge 18 are defined by a plurality of walls including bottom wall 20, side walls 22 and 24, and top wall 26. These walls are closed at the rear by the panel 28. The rear wall 30 that defines the work area 16 is permeable for the passage of air, and in the disclosed embodiment of the invention is primary air or HEPA filter 30. The primary air or HEPA filter 30 also cooperates with the walls 20, 22, 24, 26 and the rear panel 28 to define the first or upper primary air plenum chamber 32. The bottom wall 20 has provided across its width air distribution baffles 34 above the longitudinal port 36 for distributing air uniformly within the air plenum chamber 32.

Figure 3:
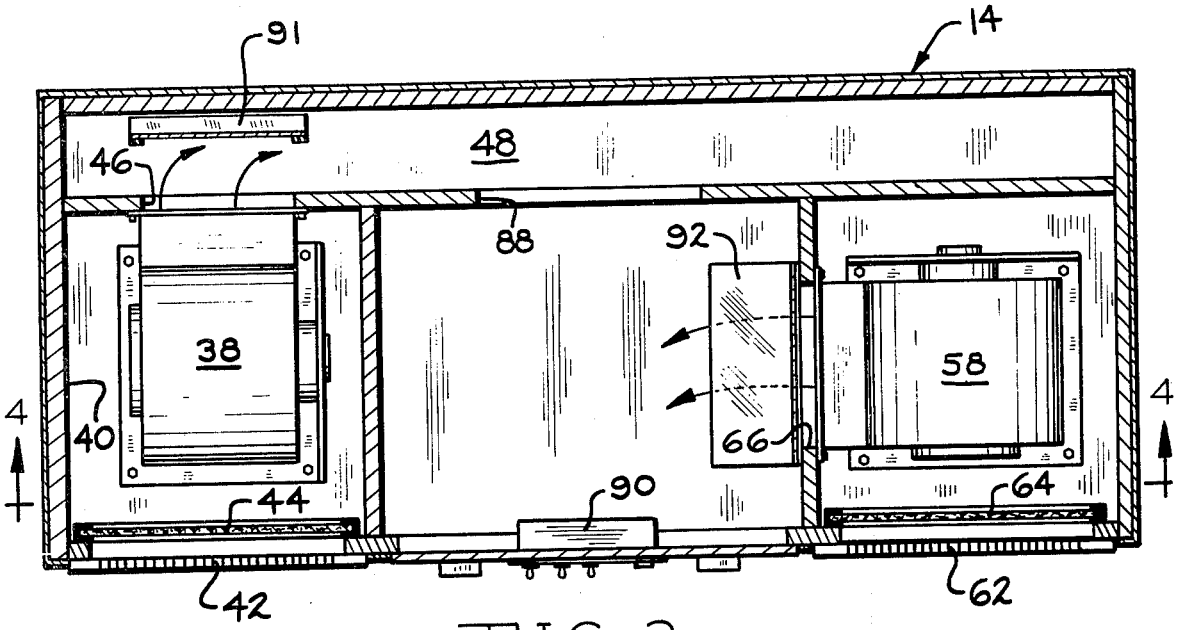
FIG. 3 is horizontal section taken on the line 3—3 of FIG. 2.
Figure 4:
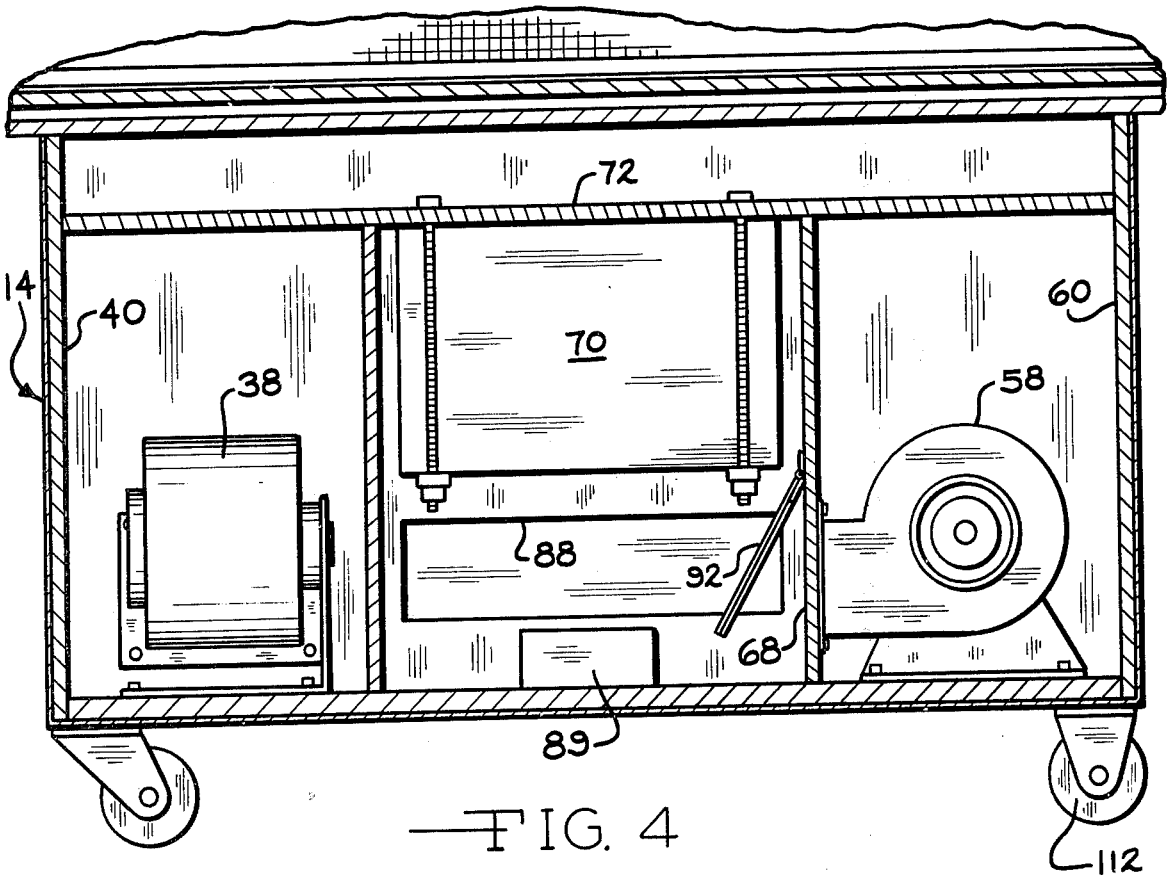
FIG. 4 is a vertical section taken on the line 4—4 of FIG. 3.

The air supply means which is the source of air for delivery through the port 36 is located in the support stand 14. As seen in FIGS. 3 and 4, a primary air supply blower 38 is mounted in the compartment 40 and is adapted to draw air through the front grill 42 and filter 44 into the compartment 40 for discharge via the outlet 46 into the lower or second primary air plenum chamber 48. The air discharged will then pass upward through the longitudinal port 36 and the air distribution baffles 34 into the first or upper primary air plenum chamber 32. From chamber 32 the air will pass through the HEPA filter 30 and the grill 50 into the work area 16. As indicated by arrows 52, this air will constitute laminar flow for discharge out of the open end of the work area 16.

The walls 20, 22, 24 and 26 are constructed so as to define perimeter air ducts 54 which terminate at the continuous leading edge 18 in the linear air nozzle 56. Perimeter air is supplied to the air ducts 54 from a source of air which is located in the support stand 14. A perimeter air supply blower 58 which is part of the air supply means for the workbench 10 is mounted in the compartment 60 and is adapted to draw air through the front grill 62 and filter 64 into the compartment 60 for discharge via the outlet 66 into the lower perimeter air plenum chamber 68. The air discharged will then pass upward through the perimeter air or HEPA filter 70 which forms the upper wall of the second perimeter plenum chamber 68, and from there into the first perimeter air plenum chamber 72 of which the HEPA filter 70 forms the bottom wall, and the filtered air can then pass from the first perimeter air plenum chamber 72 through the port 74 into the perimeter air ducts 54. The port 74 extends across the bottom wall 20, the full width thereof. The perimeter air ducts 54 include the baffles 76 which aid in distributing the perimeter air more uniformly throughout the entire circumference of the perimeter air ducts 54.

Figure 6:
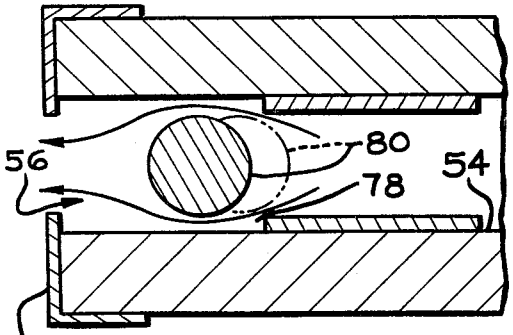
FIG. 6 is a similar enlarged fragmentary sectional view taken on the line 6—6 of FIG. 1 showing other details of the leading edge and air nozzle means.
Figure 5:
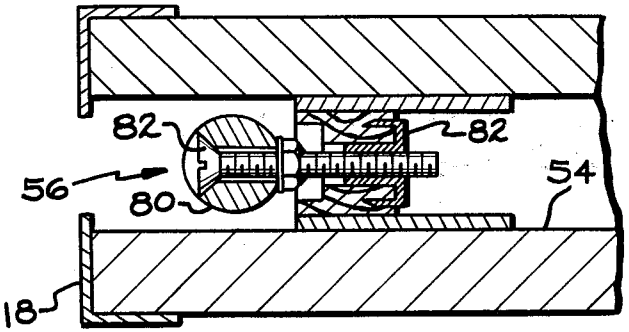
FIG. 5 is an enlarged fragmentary section taken on the line 5—5 of FIG. 1 showing details of the leading edge and of the air nozzle means for discharging the air curtain.

With particular reference to FIGS. 5 and 6, the air nozzle means 56 will be described in greater detail. The air nozzle means 56 include the linear discharge port 78 and the flexible valve element 80 which is mounted on a plurality of support brackets 82 for selectively varying the spacing of the valve element 80 with respect to the linear discharge port 78. As seen in FIG. 6, if the valve element 80 is moved from the solid line position to the broken line position shown therein the effective opening of the linear discharge port 78 will be reduced. By suitably advancing or retracting the valve element 80 by the turning of the adjustment screw 82, selective positioning of the valve element 80 may be obtained. This adjustment feature allows the operator of the unit to assure that an air screen of desired intensity is provided entirely around the periphery of the work area. It also allows the operator to selectively choose a screen of greater intensity at any specific location, such as, for example, at the top of the work area, as distinguished from the intensity at the bottom of the work area.

Figure 2:
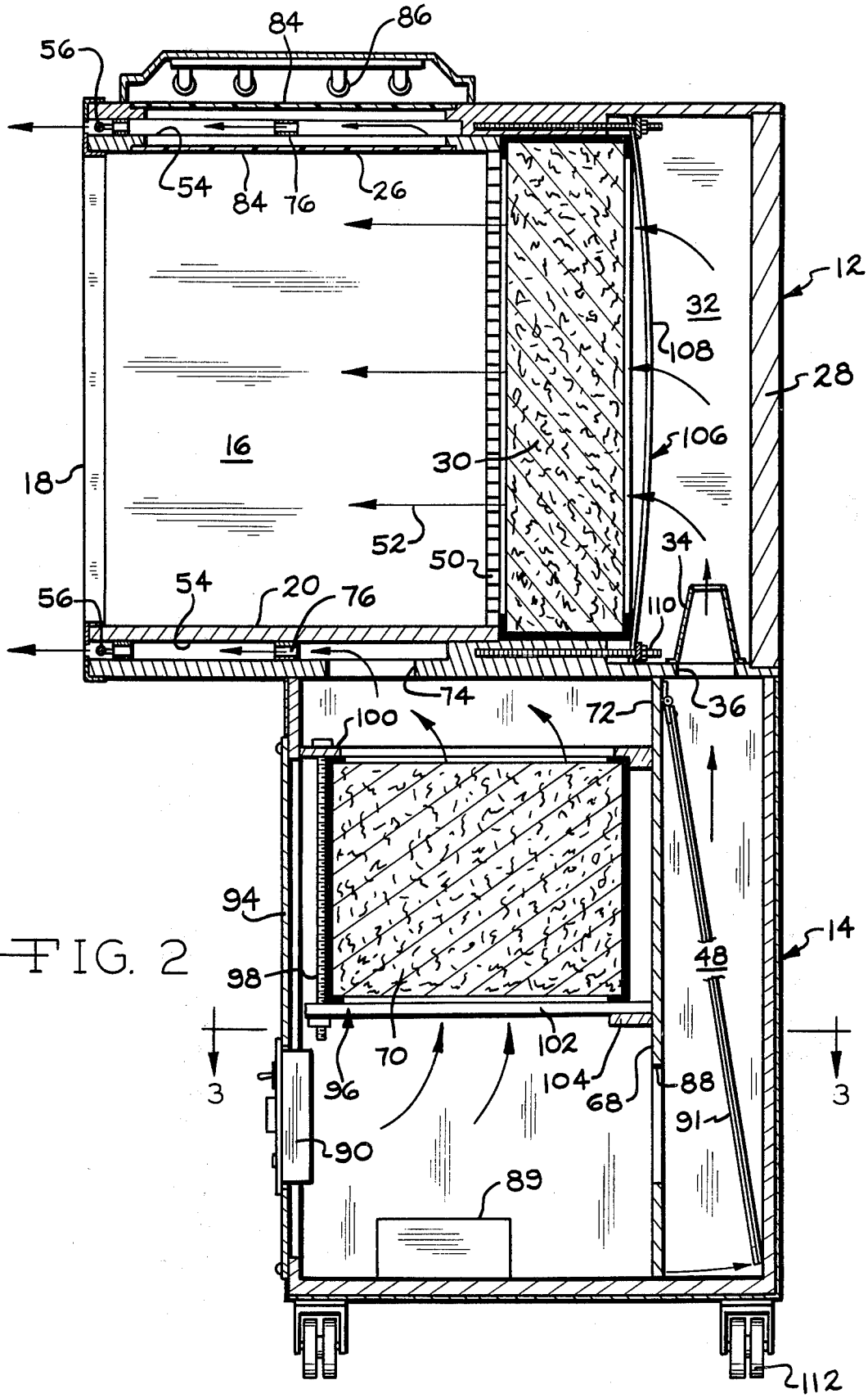
FIG. 2 is a vertical section taken on the line 2—2 of FIG. 1.

With particular attention to FIG. 2, it will be observed that the top wall 26 includes two transparent plastic sheets 84 which help define the perimeter duct 54 and which are located inward of the illuminating fluorescent lamp fixtures or tubes 86 for providing illumination of the work area 16. These illuminating sheets or wall panels 84 are included in the air duct so that a cooling effect is provided to transfer heat that otherwise would be transmittted into the work area out of the discharge air nozzle means 56. In the illustrated embodiment, the upper transparent sheet is a clear transparent acrylic sheet, and the lower transparent sheet is a clear prismatic, light scattering sheet.

With particular reference to FIGS. 2, 3 and 4, it will be noted that the second perimeter air plenum chamber 68 and the second primary air plenum chamber 48 are in communication via the port 88. By virtue of this arrangement the air supply means which includes the primary air supply blower 38 and the perimeter air supply blower 58 will continue to supply filtered air both for the laminar air flow through the work area and also for the air curtain, even if one of the blowers 38 and 58 should inadvertently fail. This assures that work can continue in the work area even in the event of a failure of this nature. The communication port or air flow exchange opening 88 also serves an additional function in that it avoids undesirable air harmonics from being transmitted through one or the other of the air passage means for the primary air or for the perimeter air, because the harmonics that might be generated in one system will necessarily be different than that generated in the other air passage means so as to produce the effect of dampening out the harmonics established in the other air passage means.

Thus, by providing the air flow exchange through the port or opening 88 additional air capacity is also provided to the primary filtration supply system. This assures better balance characteristics, even distribution of the primary air supply, and maintenance of the parallel air streams that are discharged from the HEPA filter 30 through the work area 16. This redundancy also provides an additional benefit by maintaining at all times a circulation of cooling air over heat emitting electrical elements located within the control modules or panels 89 and 90. Backdraft damper doors 91 and 92 to ensure pressure maintenance in the event either blower 38 or 58 should fail are located at the outlet area of each of the blowers as shown in FIGS. 2, 3 and 4. These doors 91 and 92 are hingedly connected for free swinging with suitable light gasket seals between each door and the air discharge outlet in the wall panel on which they are mounted. Thus, the doors will operate solely by pressure differentials and gravity.

When it is desired to replace the HEPA filter 70, the operator can readily accomplish this by removing the front access panel 94 and releasing the holding means 96.

The latter includes two vertical removable threaded lockdown rods 98 affixed to the lockdown board 100, which also provides the seat for the HEPA filter 70. Secured by the rods 98 are the levers 102 which act on pry blocks 104.

When it is desired to replace the HEPA filter 30, this can be accomplished by removing the rear panel 28 and then releasing the spring clamp mechanism 106. The HEPA filter 30 is urged forward to maintain a tight peripheral seal by action of the spring constant clamps or lockdown bars 108 which are retained in their bowed positions by the rods 110. Also, suitable mounting wheels 112 are provided for moving the workbench 10 to desirable locations.

It is claimed:

1. A workbench comprising a work platform having a work area defined by a plurality of walls that are open at the front of the work area at a leading edge to provide access to the work area, the rear wall of said plurality of walls being permeable for passage of air, air nozzle means extending around said work area at said leading edge for directing a curtain of air forward of said work area, and air supply means for supplying air to said permeable wall and to said air nozzle means so that air can be directed forward through said work area as laminar flow and air can be directed from said air nozzle means as a curtain surrounding the laminar flow of air from said work area, interior portions of said walls being transparent and contain illumination apparatus for illuminating said work area, and said air supply means includes perimeter air ducts that extend through said walls to said air nozzle means, said portions forming a part of said perimeter air ducts so that passage of air therethrough will serve to cool said illumination apparatus.

2. The workbench that is defined in claim 1, wherein said air supply means includes a plenum chamber located on the rear side of sid permeable wall for delivering of air through said permeable wall to provide laminar flow of air through said work area.

3. The workbench that is defined in claim 2, wherein said permeable wall is a HEPA filter.

4. A workbench comprising a work platform having walls and a primary air filter forming a work area that is open at the front end and is defined by said walls around the top, bottom and sides and by said primary air filter at the rear, said walls providing a continuous leading edge around the open front of the work area, an air nozzle means extending round the work area at said leading edge for directing a curtain of filtered air forward of said work area, air supply means (1) for delivering filtered air through said air nozzle means and (2) for delivering air under pressure to the rear of said air filter for passage therethrough to provide laminar flow of filtered air forward through said work area for discharge out of the front of said work area within said air curtain, said air nozzle means being a linear nozzle that has linear discharge port extending parallel to the direction of said leading edge, and a valve element extending parallel to said port and movable relative to said port for varying the air flow therefrom, said valve element being flexible and adjustable at a plurality of locations along its length to adjust selectively the air flow around the perimeter of said work area.

5. The workbench that is defined in claim 4, wherein said air supply means comprises a primary air supply blower and primary air passage means for delivering said air under pressure to the rear of said air filter, and a perimeter air supply blower and a perimeter air passage means containing an air filter for delivering filtered air through said air nozzle means.

6. The workbench that is defined in claim 5, wherein said primary air passage means and said perimeter air passage means are in communication with one another so that in the event of failure of one of said blowers the other blower will serve both air passage means, and said primary and perimeter air passage means contain backdraft damper doors adjacent to each of the associated blowers, each door being operable to close automatically if its blower should fail.

7. The workbench that is defined in claim 6, wherein said primary air passage means includes a plenum chamber of which said primary air filter defines the front wall, said primary and said perimeter air passage means being in communication with one another upstream of said filters to provide smoother and more balanced air flow to said plenum chamber.

8. A workbench comprising a support stand, a work platform positioned on said support stand and having side, top and bottom walls closed at the rear by a rear panel and open at the front, a primary air filter mounted between said walls forward of said panel in spaced relation thereto to define with said walls a work area open to the front of the support stand and to define with said walls and said panel a first primary air plenum chamber to the rear of the primary filter so that primary air supplied to said plenum chamber can flow through said filter and then through said work area in laminar flow for discharge through said open front, said walls also defining perimeter air ducts that terminate at the front edges of the walls in a substantially continuous linear discharge outlet located around the perimeter of said work area for discharging an air curtain around the air that is discharged through said open front, said support stand including a second primary air plenum chamber located below said first primary air plenum chamber and in communication with the latter, a first perimeter air plenum chamber in communication with said perimeter air ducts, said first perimeter air plenum chamber having one wall defined by perimeter air filter, a second perimeter air plenum chamber adjacent to said first perimeter air plenum chamber and in which said perimeter air filter defines a wall thereof, and air supply means for delivering air under pressure to said second primary air plenum chamber and said second perimiter air plenum chamber for ultimate discharge through said work area and as said air curtain, said air supply means including a primary air supply blower mounted in said support stand for delivering air to said second primary air plenum chamber and a perimeter air supply blower mounted in said support stand for delivering air to said second perimeter air plenum chamber, said second primary air plenum chamber and said second perimeter air plenum chamber being in communication so that if one of said blowers fails, the other can supply air to both of the communicating plenum chambers, and backdraft damper doors located in the air supply means adjacent to the discharge outlets of each of said blowers to prevent return flow toward either blower that might fail.

9. The workbench that is defined in claim 8, wherein sid backdraft damper doors are hingedly mounted so as to operate by pressure differentials and gravity.

* * * * *

UNITED STATES PATENT OFFICE

CERTIFICATE OF CORRECTION

Patent No. 4,016,809 Dated April 12, 1977

Inventor(s) Philip R. Austin

It is certified that error appears in the above-identified patent and that said Letters Patent are hereby corrected as shown below:

In the Abstract:

Line 6, "certain" should be -- curtain --.

In the Claims:

Claim 2, Column 4, line 68, "sid" should be -- said --.
Claim 4, Column 5, line 11, "round" should be -- around --.
Claim 8, Column 8, line 25, "defined by perimeter" should read -- defined by a perimeter --.
Claim 9, Column 6, line 47, "sid" should be -- said --.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*